United States Patent [19]

Fenwick

[11] 4,063,250

[45] Dec. 13, 1977

[54] BEAM AND NULL SWITCH STEP STEERABLE ANTENNA SYSTEM

[75] Inventor: Richard C. Fenwick, Dallas, Tex.

[73] Assignee: Electrospace Systems, Inc., Richardson, Tex.

[21] Appl. No.: 641,304

[22] Filed: Dec. 16, 1975

[51] Int. Cl.[2] ..... H01Q 3/26

[52] U.S. Cl. ..... 343/844; 343/854; 343/894

[58] Field of Search ..... 343/844, 854, 853, 894

[56] References Cited

U.S. PATENT DOCUMENTS

| | | | |
|---|---|---|---|
| 1,950,708 | 3/1934 | von Arco | 343/854 |
| 2,160,857 | 6/1939 | Gothe | 343/876 |
| 2,432,134 | 12/1947 | Bagnall | 343/854 |
| 3,056,961 | 10/1962 | Mitchell | 343/876 |
| 3,248,736 | 4/1966 | Bohar | 343/876 |
| 3,295,138 | 12/1966 | Nelson | 343/854 |
| 3,325,816 | 6/1967 | Dutton | 343/854 |
| 3,396,398 | 8/1968 | Dunlavy | 343/844 |
| 3,480,958 | 11/1969 | Tcheditch | 343/854 |
| 3,560,985 | 2/1971 | Lyon | 343/854 |
| 3,811,129 | 5/1974 | Holst | 343/854 |

*Primary Examiner*—Eli Lieberman

*Attorney, Agent, or Firm*—Warren H. Kintzinger

[57] ABSTRACT

An antenna combiner $2^n$ antenna element system with switchable variable delay line length broadband beam and null steering through 360° in azimuth.

20 Claims, 14 Drawing Figures

Figure 1:
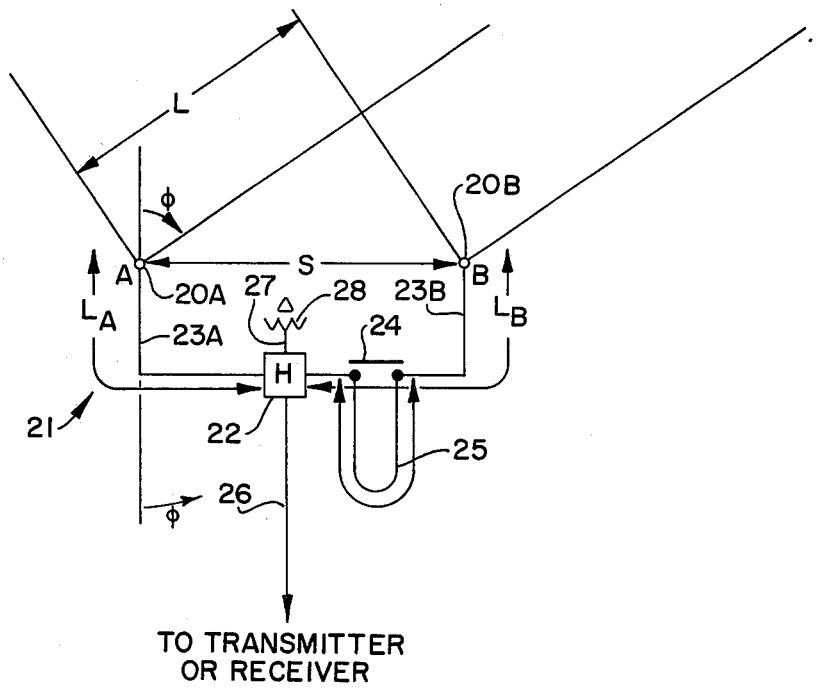

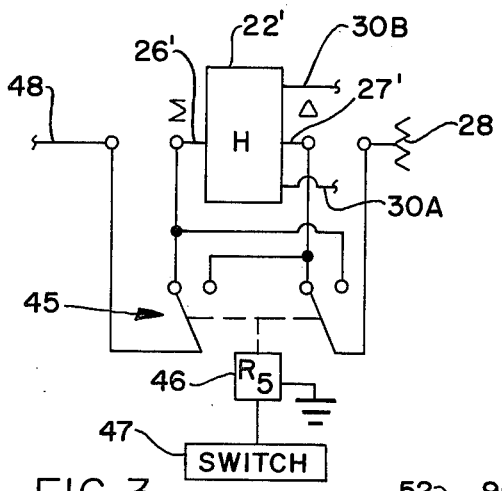
FIG. 3
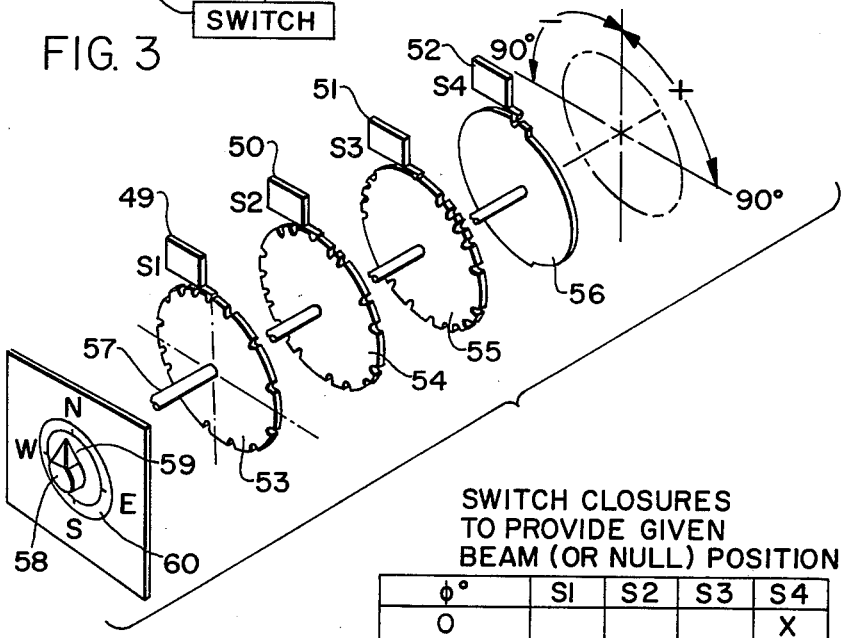
FIG. 4
SWITCH CLOSURES TO PROVIDE GIVEN BEAM (OR NULL) POSITION
| φ° | S1 | S2 | S3 | S4 |
|---|---|---|---|---|
| 0 | | | | X |
| 8.1 | X | | | X |
| 16.3 | | X | | X |
| 24.9 | X | X | | X |
| 34.1 | | | X | X |
| 44.5 | X | | X | X |
| 57.3 | | X | X | X |
| 79.0 | X | X | X | X |
| −8.1 | X | | | |
| −16.3 | | X | | |
| −24.9 | X | X | | |
| −34.1 | | | X | |
| −44.5 | X | | X | |
| −57.3 | | X | X | |
| −79.0 | X | X | X | |
S1, S2, S3 AND S4 CLOSURES CORRESPOND TO R1, R2, R3 AND R4 CLOSURES RESPECTIVELY
FIG. 5

TWO ELEMENT ARRAY, SUM PATTERN
SI = 37.50 METERS, .500 WAVELENGTHS
THE BEAM IS AT PHI = 0.0 DEGREES
PHI IS VARIABLE,
FREQUENCY = 4.0 MHZ

TWO ELEMENT ARRAY, SUM PATTERN
SI = 37.50 METERS, .500 WAVELENGTHS
THE BEAM IS AT PHI = 16.3 DEGREES
PHI IS VARIABLE,
FREQUENCY = 4.0 MHZ

TWO ELEMENT ARRAY, SUM PATTERN
SI= 37.50 METERS , .500 WAVELENGTHS
THE BEAM IS AT PHI = 34.1 DEGREES
PHI IS VARIABLE ,
FREQUENCY = 4.0 MHZ

TWO ELEMENT ARRAY, SUM PATTERN
SI= 37.50 METERS , .500 WAVELENGTHS
THE BEAM IS AT PHI = 57.3 DEGREES
PHI IS VARIABLE ,
FREQUENCY = 4.0 MHZ

| | CONTROL FOR C2 | | | | CONTROL FOR CI AND C3 | | | |
|---|---|---|---|---|---|---|---|---|
| $\phi°$ | SI | S2 | S3 | S4 | SI | S2 | S3 | S4 |
| 0 | | | | X | X | X | X | |
| 8.1 | X | | | X | X | X | X | |
| 16.3 | | X | | X | X | X | X | |
| 24.9 | X | X | | X | | X | X | |
| 34.1 | | | X | X | | X | X | |
| 44.5 | X | | X | X | X | | X | |
| 55.9 | | X | X | X | | | X | |
| 65.1 | | X | X | X | X | X | | |
| 73.7 | X | X | X | X | | X | | |
| 81.9 | X | X | X | X | X | | | |
| 90 | X | X | X | X | | | | |
| 98.1 | X | X | X | X | X | | | X |
| 106.3 | X | X | X | X | | X | | X |
| 114.9 | | X | X | X | X | X | | X |
| 124.1 | | X | X | X | | | X | X |
| 134.5 | X | | X | X | X | | X | X |
| 145.9 | | | X | X | | X | X | X |
| 155.1 | X | X | | X | | X | X | X |
| 163.7 | | X | | X | X | X | X | X |
| 171.9 | X | | | X | X | X | X | X |
| 180 | | | | X | X | X | X | X |

FOR $\phi$ = 0 TO - 180°, SWITCH CLOSURES ARE THE SAME AS ABOVE EXCEPT C2S4 IS OPEN AT ALL ANGLES CONTROL SWITCH CLOSURES FOR BEAM OR NULL STEERING OF A 4 ELEMENT RECTANGULAR ARRAY

BEAM AND NULL SWITCH STEP STEERABLE ANTENNA SYSTEM

This invention relates in general to antenna phased array systems, and in particular to an antenna combiner system of $2^n$ elements with switchable variable delay line length broadband beam and null steering.

There are many antenna phased array steering systems in existance using varous approaches for beam steering control. Some of these use power variation control combined with multiplexing of inputs to the antenna elements in a feed system, from a plurality of transmitter signal sources for the transmit mode of operation, in the attainment of beam steering control. Other systems employ delay line length control in various feed combiner systems to a plurality of antenna elements, for beam steering control. Many of these existing systems, however, are quite complex and expensive, and are not capable of providing the flexibility and extent of beam and null steering control desired for some applications.

It is therefore a principal object of this invention to provide an antenna combiner system for a plurality of antenna elements with switchable variable delay line length broadband beam steering.

Another object is for such an antenna combiner system to provide null steering.

A further object is to provide such an antenna combiner system for $2^n$ antenna elements with beam steering delay line length switching controlled angular steps.

Features of this invention useful in accomplishing the above objects include, switchable delay line feed network antenna system beam or null steering by a single control calibrated in azimuth, independent of the antenna element electrical spacing or number of antenna elements (i.e., $2^n$ elements—2, 4, 8, etc. elements). This provides steering by angular steps, the number of which may be arbitrarily large with a large number of delay line lengths includable by switch selected length control.

Figure 2:
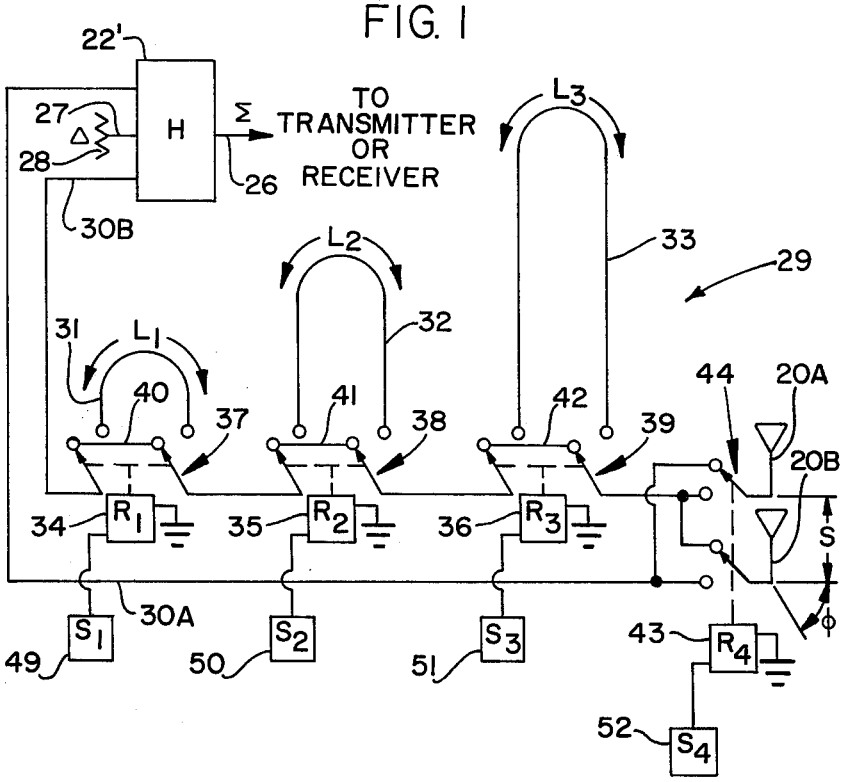
Figure 6:
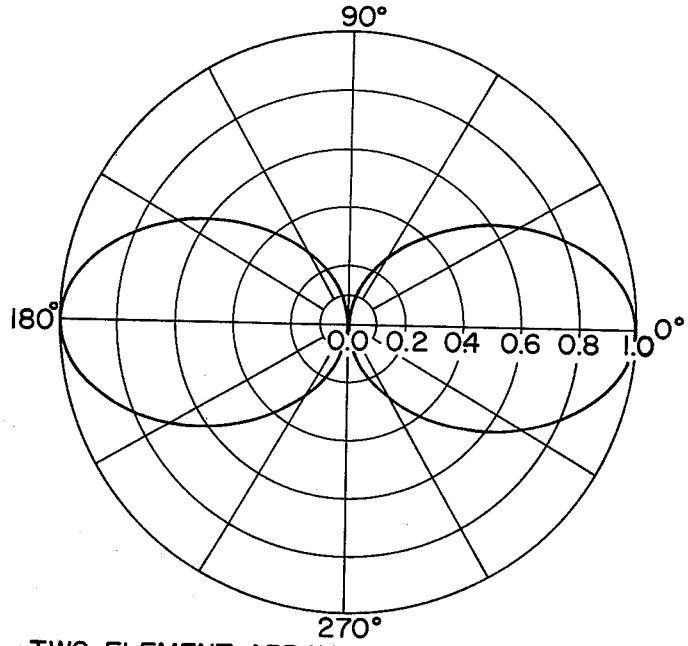
Figure 7:
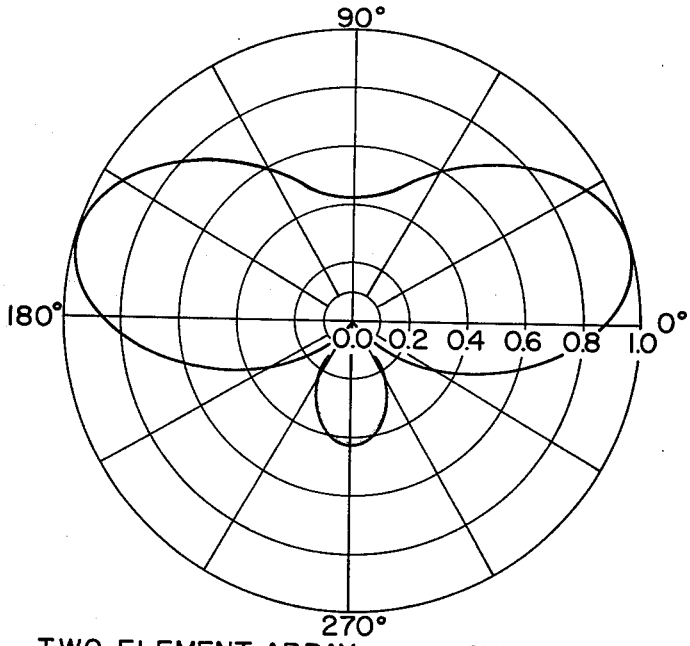
Figure 8:
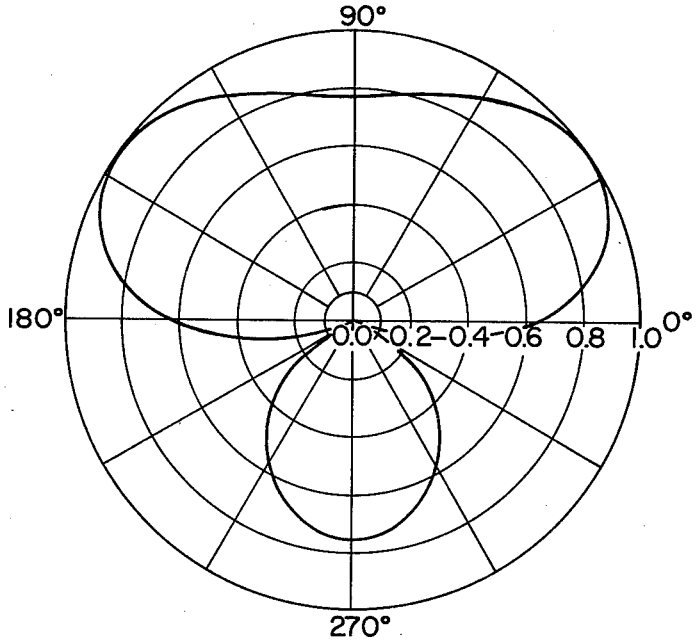
Figure 9:
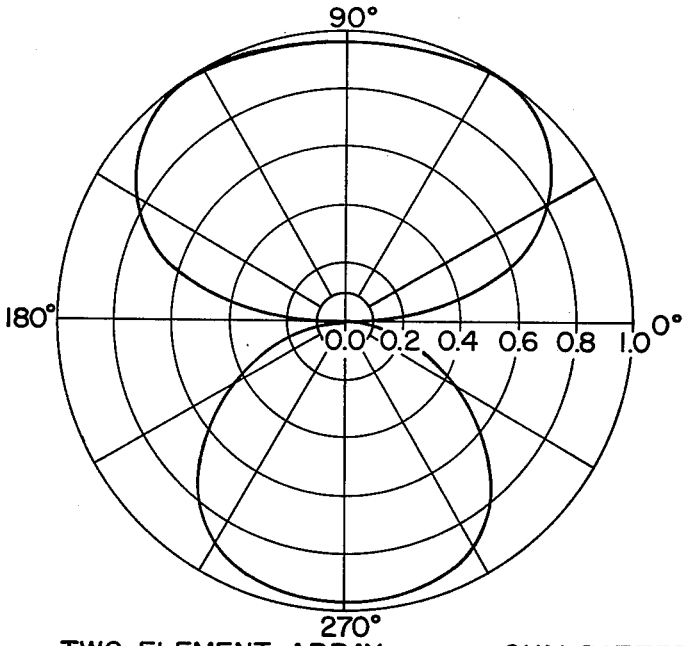
Figure 10:
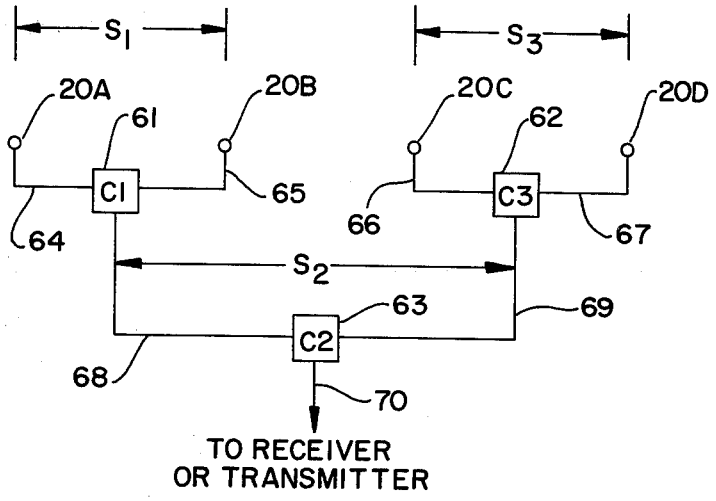
Figure 11:
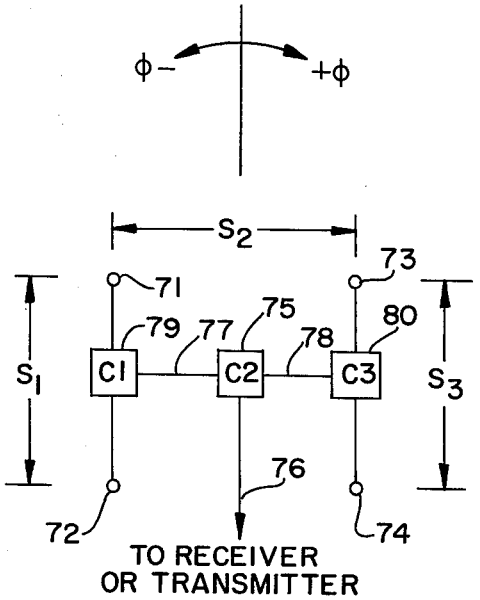
Figures 12, 13:
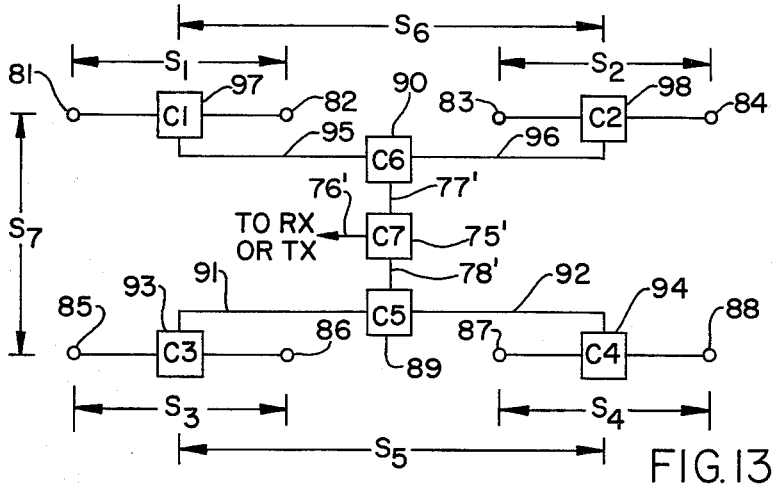
Figure 14:
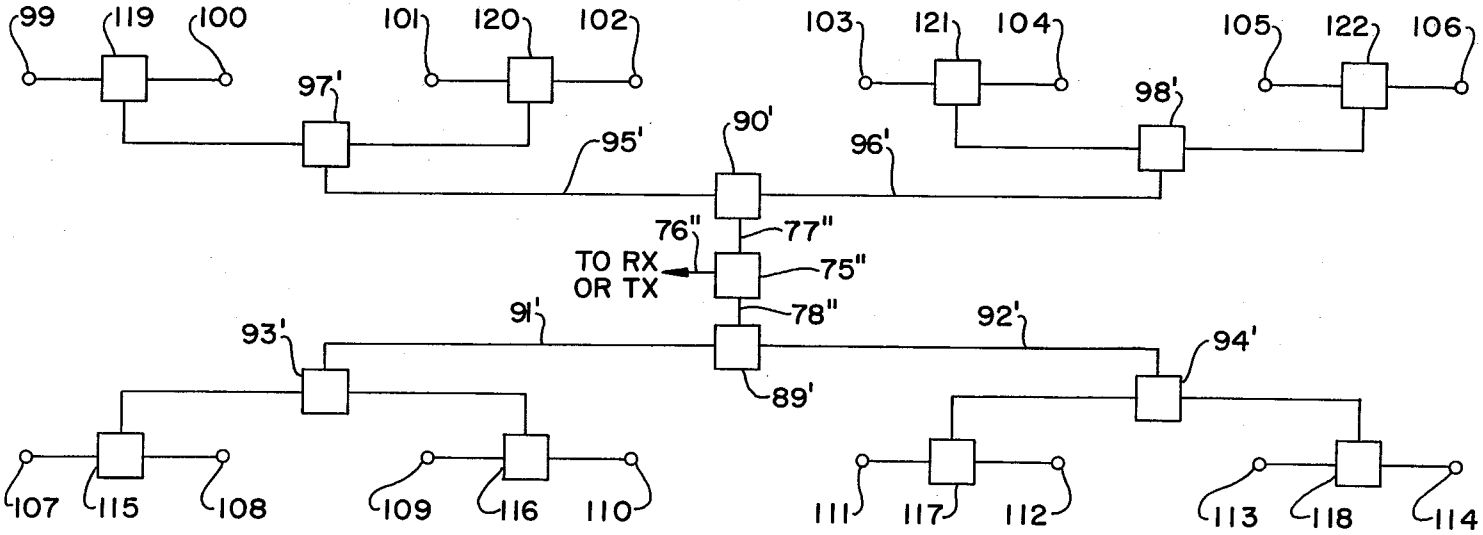

Specific embodiments representing what are presently regarded as the best modes of carrying out the invention are illustrated in the accompanying drawings. In the drawings:

FIG. 1 represents a schematic of a two element antenna array with the elements connected to a hybrid transformer through nominally equal length transmission lines and with an additional transmission line length switchable into and out of series with one of the equal length transmission lines;

FIG. 2, a schematic of a two element antenna array and a combiner including a hybrid transformer and a transmission line having switchable delay line segments and transmission lines switchable between antenna elements providing 360° beam steering in some 28–30 steps;

FIG. 3, a partial schematic of a hybrid transformer switching connection for switching from broadband beam steering to null steering with the output taken from the hybrid difference port Δ;

FIG. 4, an exploded perspective view of a cam switch structure such as would be employed for activation of delay line switch throwing relays with the embodiment of FIG. 2;

FIG. 5, a switch closure chart for the cam switch structure of FIG. 4 as used for the two element antenna array of FIG. 2;

FIGS. 6 through 9, two element array sum patterns with beams respectively at Phi=0.0°, 16.3°, 34.1° and 57.3°;

FIG. 10, a schematic of a four element linear array with three combiners and the spacing between paired elements substantially equal;

FIG. 11, a schematic of a four element rectangular array with three combiners;

FIG. 12, a switch closure chart for the cam switch structure of FIG. 4 as adapted to control switch closures for beam or null steering of the four element rectangular array of FIG. 7;

FIG. 13, a schematic of an eight element rectangular array with a signal combining system; and FIG. 14, a schematic of a sixteen element rectangular array with a signal combining system.

Referring to the drawings:

The two element 20A and 20B antenna system 21 of FIG. 1 is equipped with a hybrid transformer 22 connected through transmission lines 23A and 23B, respectively, to the antenna elements 20A and 20B. A hybrid transformer 22 is used to obtain equal power split independent of VSWR between transmission lines 23A and 23B, that are of equal length, when short direct connect element 24 is switched into the transmission line 23B. However, when delay line 25 of electrical length L is switched into the transmission line 23B, the transmission line 23B is transformed from electrical length $L_B$ to $L_B + L$. Hybrid transformer 22 has a connection through connection line 26 to a transmission or receiver, depending on the mode of operation, and is provided with a hybrid difference port Δ line 27 connection to an impedance termination 28. With the additional delay line 25 length L inserted in series with transmission line 23B, the radiation from the two elements 20A and 20B is caused to add in phase at angle $\phi$, measured from the broadside direction, as shown in FIG. 1. Should the output be taken from the hybrid difference port Δ line 27, by switching as shown in FIG. 3 with reference to the embodiment of FIG. 2, a 180° phase shift is introduced, providing an antenna pattern null at angle $\phi$.

With such basic beam and null direction variation characteristics of two element phased arrays known, the present invention is directed to specific methods of implementing delay line switched feed networks, such as with the embodiment of FIG. 2, to achieve 360° beam, or null steering, with a single control structure that may be calibrated in azimuth, independent of the element spacing or number of elements (i.e., for 2, 4, 8, etc. elements). This is with steering accomplished in angular steps, the number of which may be arbitrarily large.

The two elements 20A and 20B antenna system 29 embodiment of FIG. 2 is shown to have two transmission lines 30A and 30B, with transmission line 30B broken up into a number of segments, with delay lines 31, 32 and 33 of $L_1$, $L_2$, and $L_3$ lengths, respectively, switchable into and out of the line 30B singularly or in various combinations. Here some items the same, and substantially the same, as with the two element antenna system of FIG. 1 carry the same identification number or a primed number as a matter of convenience. The three segments shown are suitable for a spacing S between antenna elements 20A and 20B of up to approximately two wavelengths. It should be noted in general that a greater number of segments (such as delay line segments 31, 32 and 33) is required for large element spacing S due to narrower beams being produced with larger antenna element spacing S as related to wavelength. Further, the segment 31, 32 and 33 lengths are selected to substantially conform to a binary relationship $L_3=2L_2=4L_1$, and that $L_1 + L_2 + L_3$ is $\cong S$. Relays 34, 35 and 36 ($R_1$, $R_2$ and $R_3$, respectively) drive double pole double throw switches 37, 38 and 39, respectively, selectively, between short direct connect elements 40, 41 and 42 to delay line segments 31, 32 and 33. There is a further refinement in that the relays 34, 35 and 36 switch the segments 31, 32 and 33 in and out of a transmission line connected to one of the two antenna elements 20A or 20B, as determined by the relay 43 ($R_4$) activated state of double pole double throw switch 44. Thus, this arrangement where the lengths $L_1 + L_2 + L_3 + L$ provides selectable beam maxima at $\phi = \pm 8.2°$, 16.6°, 25.4°, 35°, 45.5°, 50° and 90°, substantially independent of the spacing of the antenna elements 20A and 20B, or the RF employed. A preferred embodiment $L=0.9816$ S results in slightly more uniform azimuthal spacing between beam positions through the entire 360°, with the selectable maxima (or nulls) occurring at $\phi = \pm 8.1°$, 16.3°, 24.9°, 34.1°, 44.5°, 57.3° and 79°. Null steering at angle $\phi$ is accomplished through introduction of a 180° phase shift by switching a hybrid transformer 22 (as in FIG. 3) to take the output from the hybrid difference port $\Delta$ line 27. Thus, double pole double throw switch 45 is driven by relay 46 ($R_5$), as controlled by switch 47, that may be manually controlled, from the switch state shown to connection of line 48 to the difference port $\Delta$ line 27′ and connection of line 26′ to impedance termination 28.

The relays 34, 35, 36 and 43 (relays $R_1$, $R_2$, $R_3$ and $R_4$) are controlled by snap action $S_1$–$S_4$ switches 49, 50, 51 and 52, respectively, that, as shown in FIG. 4, are actuated by cam wheels 53, 54, 55 and 56, respectively, mounted on a common shaft 57 connected to and turned by knob 58. The pointer 59 of knob 58 of this single-knob control gives direct readout on dial 60 of beam (or null) azimuth with "N" on the dial corresponding to $\phi = 0$, if the two antenna elements 20A and 20B are on the East-West line. If the antennas are not on an East-West line, the knob 58 need only be loosened (knob-to-rod set screw setting) and rotated about the shaft and reset to correct for azimuth offset of the antenna baseline. Notches in the cams 53, 54, 55 and 56, in addition to switch activation, give a detent feel so the operator can feel switch activated beam (or null) azimuth position step steering positions. The switch closure chart of FIG. 5 illustrates switch closures required to give respective beam (or null) azimuth settings with closures of respective $S_1$, $S_2$, $S_3$ and $S_4$ switches 49, 50, 51 and 52 of the cam switch structure of FIG. 4 and the embodiment of FIG. 2 indicated by X's. This is with $S_1$, $S_2$, $S_3$ and $S_4$ closures corresponding to $R_1$, $R_2$, $R_3$ and $R_4$ closures of switches 37, 35, 36 and 44 to insert delay line segments 31, 32 and 33 and connection of transmission lines 30A and 30B to antenna elements 20A and 20B, respectively. Please note that a single disc cam structure rotatably mounted with a knob 58 on a common shaft may be used in place of separate cam discs for each switch. This is accomplished by having switches engaging different cam configured portions of the same disc in an approach that has been constructed and found to work out quite well.

FIGS. 6 through 9 show sum patterns for the two elements 20A and 20B array of FIG. 2 with an element spacing of S = 37.50 meters (0.500 wavelengths) for a frequency of 4.0 MHz, and with the beam at Phi = 0.0°, 16.3°, 34.1° and 57.3°, respectively.

It is of interest to note that with the basic feed structure for the two antenna elements 20A and 20B of FIG. 2 and the cam switch structure of FIG. 4 (or a one disc cam equivalent thereof) along with, as appropriate, the hybrid transformer switching control system of FIG. 3 combiners are readily configured for a linear array of $2^n$ elements. In FIG. 10, for example, with $n = 2$, a four element array configuration is shown wherein spacing between paired elements of groups of pairs must be equal as with $S_1 = S_3$, while $S_2$ of FIG. 10 may be any reasonable distance. In FIG. 10, C1, C3 and C2 combiners 61, 62 and 63 are, with combiners 61 and 62 including switchable delay line segments as with the embodiment of FIG. 2, switch controlled by a unitary cam switching control as shown in FIG. 4, are connected, respectively, through transmission lines 64, 65, 66 and 67 to elements 20A, 20B, 20C and 20D. The C2 combiner 63 is the same as the C1 and C3 combiners 61 and 62, except that it is connected through transmission lines 68 and 69 to the combiners 61 and 62, and through line 70 to a receiver or transmitter, depending on the mode of operation, and the cam switching control for all the combiners is located therewith, although it could be located elsewhere. Thus, an antenna system is provided with multiple two element combiner assemblies for beam (or null) steering of a four element linear array as controlled by a single switching control cam switch structure.

The four element 71, 72, 73 and 74 rectangular antenna array of FIG. 11 is steerable using the same switching combiner assembly 75 as with FIGS. 2 and 4 as the C2 combiner having a line 76 connection to a transmitter or receiver and transmission line connections 77 and 78 to C1 and C3, combiners 79 and 80 with modification of the single switching control cam switch structure with four extra switches added for control of the combiners 79 and 80. The C2 combiner 75 is in the broadside ($\phi=0$) condition when the C1 and C3 combiners are in the end-fire ($\phi=\pm 90°$) condition. This is with the C1 and C3 combiners 79 and 80, including control switches and cam drive control in common with the C2 combiner 75, except the control switches (or the switch actuating cams) are angularly displaced by 90°, switches about the cam or cams relative to the switches with, however, a modification factor. This modification of the switch actuating cams is required since the angular switching positions do not exactly correspond.

The switch closure chart of FIG. 12 illustrates switch closures rquired to give respective beam (or null) azimuth settings with closures of respective $S_1$, $S_2$, $S_3$ and $S_4$ switches in the single switching control cam switch structure wire connected to respective relays of the respective C2, and C1 and C3 combiners 75 and 79 and 80 to attain the desired operational performance of the FIG. 11 four element rectangular array. This is with modification of switch cam combinations for the C1 and C3 combiners 79 and 80, so that the various $S_1$, $S_2$, $S_3$ and $S_4$ switches are actuated in accord with X indications at respective $\phi$ degree beam (or null) azimuth settings for the case where L = 0.9816 S and three switchable delay line segments used in a transmission line in each of the combiners.

Further combinations of the switching and control assemblies such as hereinbefore described can be made in configuring additional linear and rectangular arrays of $2^n$ elements, where $n$ is any integer. Rectangular arrays, such as the array of FIG. 11, the eight element array of FIG. 13, and the 16 element array of FIG. 14, are defined as combinations of two or more linear arrays, such that four lines interconnecting all of the antenna elements form a rectangle.

With the eight element 81, 82, 83, 84, 85, 86, 87, and 88 rectangular antenna array of FIG. 13, it is required that $S_1$, $S_2$, $S_3$ and $S_4$ all be substantially equal and that the elements be arranged in two substantially parallel linear element array sections, each combined to feed the final C7 combiner 75'. The C7 combiner 75' has a line 76' connection to a transmitter or receiver and transmission line connections 77' and 78' to C5 and C6 combiners 89 and 90. Combiner 89 has transmission line connections 91 and 92 to combiners 93 and 94 that are transmission line connected to element pairs 85 and 86, and 87 and 88, respectively, and in like manner combiner 90 has transmission line connections 95 and 96 to combiners 97 and 98, that are transmission line connected to element pairs 81 and 82, and 83 and 84. Combinations of broadside ($\phi=0°$) and end-fire ($\phi=\pm 90°$) combiners and controls are such as used with the four element rectangular antenna array of FIG. 11. In the eight element rectangular array of FIG. 13 the total possible delay line length for each combiner C1 through C7 is made to be equal to or slightly less than the corresponding spacing $S_1$ through $S_7$. Thus, the number of delay line segments required in various transmission lines and hence the number of cam operated switches and the number of beam (or null) positions depends on the total array dimensions in wavelengths.

FIG. 14 illustrates extension of the basic concepts to a 16 element 99 through 114 array. This antenna array includes extension of corresponding sections and items of the eight element rectangular array of FIG. 13, with various items given double primed and primed numbers, and since functions are duplicated and/or comparable here, redundant explanation is omitted at this point. Please note, however, that an additional tier of combiners is provided in the feed network to each of the two linear array sections of the overall antenna array system. This is with transmission line connections from combiners 93', 94', 97', and 98' to, respectively, the outer tier combiners 115 through 122, in turn connected to respective pairs of the antenna elements 99 through 118.

Whereas this invention is herein illustrated and described with respect to several embodiments hereof, it should be realized that various changes may be made without departing from essential contributions to the art made by the teachings hereof.

I claim:

1. In a switch step steerable multi-element antenna array: $2^n$ antenna elements; combiner means including a hybrid transformer having a sum port, a difference port and two coupled ports connectable to a radio frequency device, and having two transmission lines each connected to a respective coupled port and half of the $2^n$ antenna elements; and switchable variable delay line length control means in at least one of said two transmission lines for electromagnetic radiation frequency signal step steering; wherein a plurality of delay line segments are included in said switchable variable delay line length control means; switch control means for switching each of said delay line segments into and out of a transmission line; and control structure means interconnecting the switch control means of the delay line segments of a transmission line; and azimuth calibration means in said control structure means; and wherein said hybrid transformer means includes switch means for switch interchanging the connection to said radio frequency device and connection of said hybrid difference port or sum port for switching the antenna array between switchable delay line beam and null steering.

2. The switch step steerable multi-element antenna array of claim 1, wherein said radio frequency device is a transmitter.

3. The switch step steerable multi-element antenna array of claim 1, wherein said radio frequency device is a receiver.

4. The switch step steerable multi-element antenna array of claim 1, including control structure means calibrated in azimuth as control means for 360° horizontal beam and null switch step steering.

5. The switch step steerable multi-element antenna array of claim 1, including a plurality of two element array sections each with a combiner unit, with each of the two element array sections having switchable variable delay line means and a hybrid transformer; and combiner circuit means between the combiner units and said radio frequency device; and wherein said control structure means includes a cam switch structure in one location wire connected to relay switch means in said combiner units.

6. The switch step steerable multi-element antenna array of claim 5, with the plurality of said two element array sections being in a linear array antenna structure.

7. The switch step steerable multi-element antenna array of claim 6, with the spacing of elements of each of said two element array sections being substantially equal between element array sections.

8. The switch step steerable multi-element antenna array of claim 7, with transmission line to antenna element switchable means combined with said switchable delay line segments in combiner units switchable through 360° of azimuth electromagnetic radiation frequency signal step steering.

9. The switch step steerable multi-element antenna array of claim 8, with said antenna array being a four element array.

10. The switch step steerable multi-element antenna array of claim 5, with the plurality of said two element array sections being in a rectangular array antenna structure.

11. The switch step steerable multi-element antenna array of claim 10, with the spacing of elements of each of said two element array sections being substantially equal between element array sections.

12. The switch step steerable multi-element antenna array of claim 10, wherein a combiner that is included in said combiner circuit means is in broadside condition; and said combiner units are in the end-fire condition.

13. The switch step steerable multi-element antenna array of claim 10, with transmission line to antenna element switchable means combined with said switchable delay line segments in combiner units switchable through 360° of azimuth electromagnetic radiation frequency signal step steering by a cam switch structure control from one location.

14. The switch step steerable multi-element antenna array of claim 13, with said antenna array being a four element array.

15. In a switch step steerable multi-element antenna array: $2^n$ antenna elements; combiner means including a hybrid transformer having a sum port, a difference port and two coupled ports connectable to a radio frequency device, and having two transmission lines each connected to a respective half of the $2^n$ antenna elements; and switchable variable delay line length control means in at least one of said two transmission lines for electromagnetic radiation frequency signal step steering; wherein a plurality of delay line segments are included in said switchable variable delay line length control means; switch control means for switching each of said delay line segments into and out of a transmission line; and control structure means interconnecting the switch control means of the delay line segments of a transmission line; and azimuth calibration means in said control structure means wherein three delay line segments are provided as the plurality of delay line segments in said switchable variable delay line length control means for being switched into and out of a transmission line; and with the three delay line segments having lengths $L_1$, $L_2$ and $L_3$, substantially conforming to the binary relationship $L_3 = 2L_2 = 4L_1$.

16. The switch step steerable multi-element antenna array of claim 15, wherein the said three delay line segments further conform to the relationship of $L_1 + L_2 + L_3$ approximately equalling the spacing between a pair of antenna elements.

17. The switch step steerable multi-element antenna array of claim 16, wherein the delay line total insertable length L equals substantially 0.9816 the spacing between a pair of antenna elements.

18. The switch step steerable multi-element antenna array of claim 15, including control structure means calibrated in azimuth as control means for 360° horizontal beam and null switch step steering.

19. In a switch step steerable multi-element antenna array: $2^n$ antenna elements; combiner means including a hybrid transformer having a sum port, a difference port and two coupled ports connectable to a radio frequency device, and having two transmission lines each connected to a respective half of the $2^n$ antenna elements; and switchable variable delay line length control means in at least one of said two transmission lines for electromagnetic radiation frequency signal step steering; wherein a plurality of delay line segments are included in said switchable variable delay line length control means; switch control means for switching each of said delay line segments into and out of a transmission line; and control structure means interconnecting the switch control means of the delay line segments of a transmission line; and azimuth calibration means in said control structure means wherein at least two delay line segments are provided as the plurality of delay line segments in said switchable variable delay line length control means for being switched into and out of a transmission line; and with the delay line segments having lengths $L_2$, $L_2 \ldots L_n$ substantially conforming to the binary relationship $L_n = 2L_{n-1} = 4L_{n-2} \ldots$.

20. The switch step steerable multi-element antenna array of claim 19, including control structure means calibrated in azimuth as control means for 360° horizontal beam and null switch step steering.

* * * * *